United States Patent [19]

Sugishima

[11] Patent Number: 4,831,411

[45] Date of Patent: May 16, 1989

[54] IMAGE PROCESSING APPARATUS CAPABLE OF FORMING IMAGES ON BOTH SIDES OR OVERLYING IMAGES ON ONE SIDE OF A RECORDING MATERIAL

[75] Inventor: Kiyohisa Sugishima, Yokohama, Japan

[73] Assignee: Canon Kabushiki Kaisha, Tokyo, Japan

[21] Appl. No.: 243,213

[22] Filed: Sep. 12, 1988

Related U.S. Application Data

[63] Continuation of Ser. No. 846,895, Apr. 1, 1986, abandoned.

[30] Foreign Application Priority Data

Apr. 4, 1985 [JP] Japan ..... 60-69984

[51] Int. Cl.[4] ..... G03G 15/00

[52] U.S. Cl. ..... 355/14 SH; 355/14 R

[58] Field of Search ..... 355/3 R, 3 SH, 14 R, 355/14 SH, 14 CU, 23-26; 358/300; 346/160

[56] References Cited

U.S. PATENT DOCUMENTS

| | | | |
|---|---|---|---|
| 3,960,445 | 6/1976 | Drawe | 355/24 X |
| 4,385,825 | 5/1983 | Kaneko | 355/3 SH |
| 4,466,733 | 8/1984 | Pels | 355/14 CU X |
| 4,537,497 | 8/1985 | Masuda | 355/14 SH X |

FOREIGN PATENT DOCUMENTS

| | | | |
|---|---|---|---|
| 56-22447 | 3/1981 | Japan | 355/3 R |
| 56-22463 | 3/1981 | Japan | 355/3 R |

*Primary Examiner*—Arthur T. Grimley
*Assistant Examiner*—J. Pendegrass
*Attorney, Agent, or Firm*—Fitpatrick, Cella, Harper & Scinto

[57] ABSTRACT

A copying machine or the like, is capable of forming different images on one or both sides of a recording sheet. For this purpose, the copying machine has a mechanism for feeding a recording sheet to an image forming station, and another mechanism for re-feeding the sheet to the image forming station, after image formation, for forming a different image on the same or different side of a sheet of recording material.

3 Claims, 7 Drawing Sheets

IMAGE PROCESSING APPARATUS CAPABLE OF FORMING IMAGES ON BOTH SIDES OR OVERLYING IMAGES ON ONE SIDE OF A RECORDING MATERIAL

This application is a continuation of application Ser. No. 846,895, filed Apr. 1, 1986, now abandoned.

BACKGROUND OF THE INVENTION

1. Field of the Invention

The present invention relates to an image processing apparatus capable of forming different images on one or two sides of a recording material.

2. Related Background Art

In the above-mentioned field, there is already known an apparatus in which an image is electrophotographically formed on a recording sheet supplied from a sheet feed unit according to an imaging mode selected by an operation unit. Then, the recording sheet is eventually inverted in a both-side unit and the sheet is finally discharged, for example, onto a tray, thereby forming an image or images on one or two sides of the sheet or overlaying images on one side of the sheet.

The both-side unit is so constructed as to temporarily store the recording sheet, after image recording on one side thereof, in an intermediate tray, and to feed the sheet again in synchronization with the sheet feed unit and an image forming unit, thereby forming images on both sides of the recording sheet.

However, the conventional overlay mode allows the formation of images of plural originals on one side of the sheet, but does not readily allow to overlay images of plural, arbitrary originals on a reference image. Also, complicated copying modes are an obstacle to the user, even though copies can be obtained in various ways.

SUMMARY OF THE INVENTION

In consideration of the foregoing, an object of the present invention is to provide an image forming apparatus capable of overlay or two-side formation of plural images in relation to a reference image.

Still another object of the present invention is to provide an image processing apparatus capable of reading a first original as a mother original, thereby taking a side of the recording sheet bearing the image of said mother original as a reference side, and forming images of ensuing originals on the reference side or on the other side.

Still another object of the present invention is to provide an image processing apparatus having an original handling means, first and second storage means, image forming means and a control means wherein image formation is carried out by (n - 1) x m times on a first original which is initially fed by the original handling means. The image formation is carried out m times on each $n^{th}$ originals which are subsequently fed by the original handling means, upon feeding the recording materials from the storage means where n represents the number of originals, and m represents a desired number of copies to be made.

The foregoing and still other objects of the present invention, and the advantages thereof, will become fully apparent from the following description to be taken in conjunction with the attached drawings.

DETAILED DESCRIPTION OF THE PREFERRED EMBODIMENTS

Figure 1:
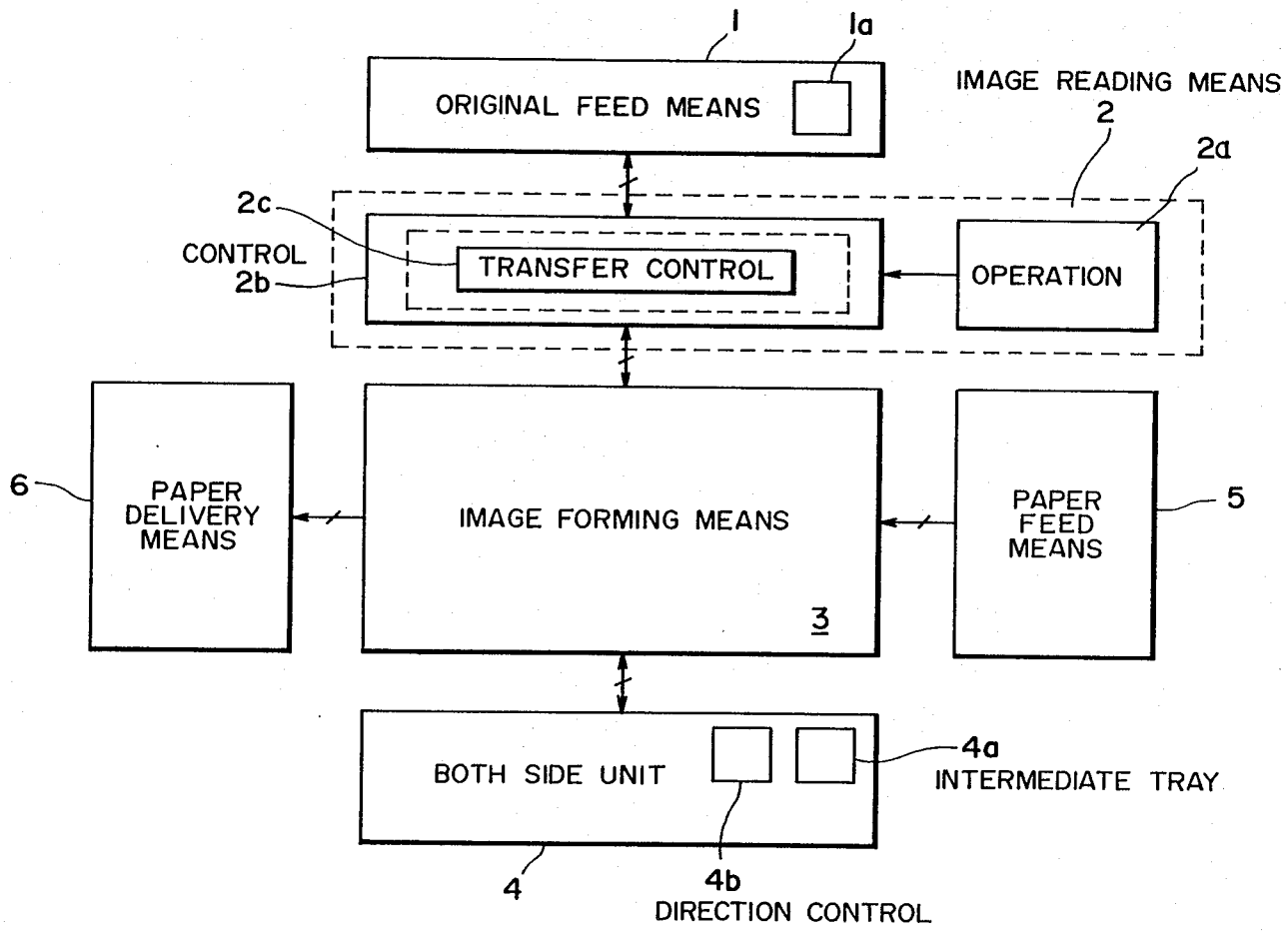
FIG. 1 is a block diagram of an image processing apparatus embodying the present invention.

FIG. 1 is a block diagram of an image processing apparatus constituting an embodiment of the present invention, wherein original feed means 1 is provided with an inverting mechanism 1*a* for inverting an original placed thereon. The original feed means 1 may be dispensed with in certain case, in which the originals are placed, one by one, manually by the operator on an unrepresented platen of image reading means 2. The means optically scans an original placed on the platen to convert the image into electrical signals by an unrepresented imaging device, such as a CCD, for modulating light signals of an unrepresented scanner in image forming means 3. The image reading means 2 is provided with an operation section 2*a*, a control section 2*b* and a transport control means 2*c*, and the control section 2*c* controls various units in response to the operational mode entered from the operation section 2*a*. The control section 2*b* communicates with said units by serial signals through unrepresented cables and interfaces, thereby enabling real-time processing. The transport control means 2*c* of the present invention controls, in an image overlay mode designated by the operation section 2, the transport of the recording sheet in such a manner that the images of arbitrary originals are formed on a reference side of the recording sheet on which the image of a first original, read by the image reading means 2. A both-side unit 4 is provided with an intermediate tray 4*a* for storing the recording sheets in transportation, and direction control means 4*b* for selectively inverting the recording sheets. Sheet feed means 5 is composed of sheet cassettes for respective sheet sizes or a paper deck holding a large amount of recording sheets. Sheet discharge means 6 is composed of a tray, a sorter etc. for stacking the one-side or two-side copies prepared in the image forming means 3, which transfers an image onto the recording sheet according to an already known electrophotographic process and in response to electrical signals supplied from the image reading means 2.

In the following there will be explained the function of the above-described apparatus.

The operator sets a desired copy mode, such as the number of copies, overlay copy, one-side copy, both-side copy, etc. in the operation section 2*a* and actuates a copy start key therein. In response an unrepresented optical system of the image reading means 2 starts to scan an original supplied from the original feed means 1 or placed by the operator on a platen, and corresponding image signals are supplied to the image forming means 3. Simultaneously a recording sheet is supplied from the sheet feed means 5 to the image forming means 3, and image formation is effected by an already known electrophographic process. If one-side copying mode is selected, the recording sheet after image formation is discharged to the sheet discharge means 6. If the both-side copying mode is selected, after the image formation on a first side of the recording sheet, the sheet is transported to the both-side unit 4 and stored temporarily in the intermediate tray 4*a*. Subsequently, when the image reading means 2 starts to read a next original placed on the platen, the control section 2*b* instructs the both-side unit 4 to re-feed the recording sheet stored therein, whereby a driving system of the both-side unit 4 transports the recording sheet from the intermediate tray 4*a* to the image forming means. Thus, image formation is effected in the same manner as explained before on the second face of the recording sheet, and, upon completion of image formation, the recording sheet is discharged to the discharge means 6.

If the operator selects an image overlay mode in the operation section 2*a* and enters the number of originals to be overlaid, the unrepresented scanning system of the image reading means 2 scans the first original supplied from the original feed means 1 as a mother original, then image formation is effected in the same manner on the recording sheets of a preset number supplied from the sheet feed means 5, and the recording sheets are transported to the both-side unit 4. Subsequently, the transport control means 2*c* releases an instruction to the direction control means 4*b* of the both-side unit 4, whereby the recording sheets are placed, with the image bearing sides downwards, on the intermediate tray 4*a*. Then in response to an instruction from the control section 2*b*, the original feed means 1 discharges the original and feeds a next original onto the platen of the image reading means 2. Subsequently, the control section 2*b* instructs the feeding of the recording sheets stacked on the intermediate tray 4*a*, and the image forming means 3 overlays an image, in response to the image signals obtained by the image reading means 2, onto a side of the recording sheet bearing the already formed image. Then, the control section 2*b* identifies whether the overlaying of originals of the preset number is completed, and, if completed, the recording sheets are discharged to the discharge means 6. On the other hand, if not completed, the above-explained procedure is repeated.

Figure 2:
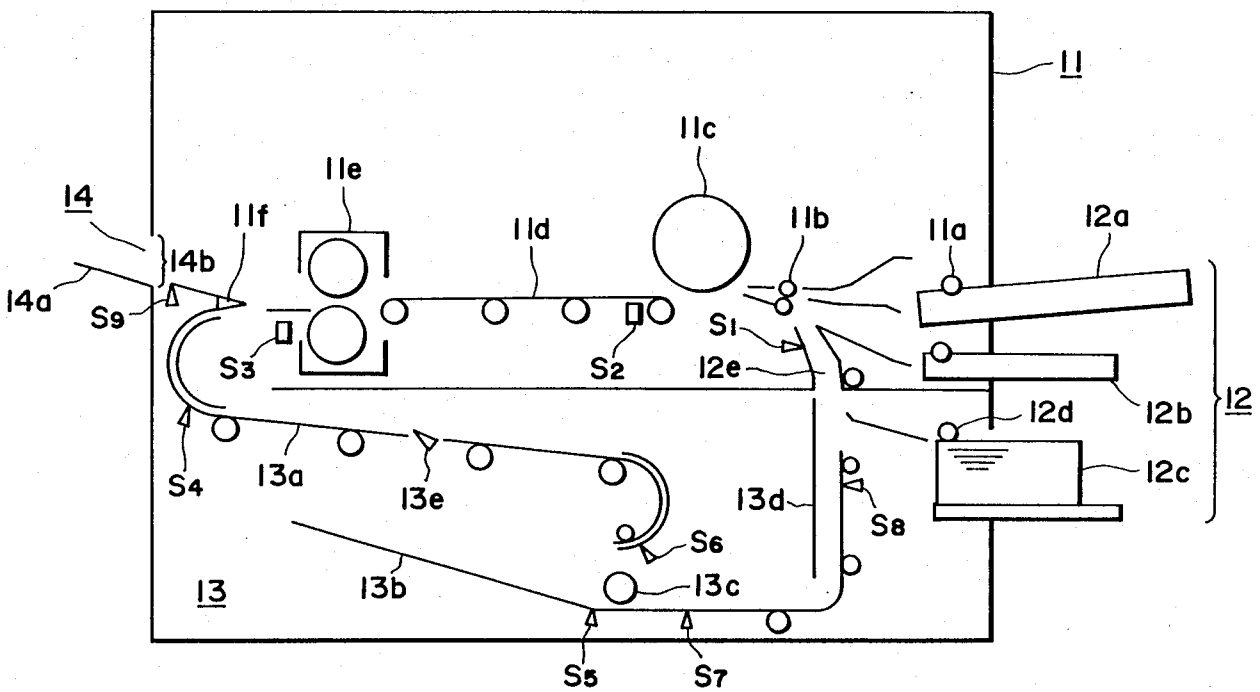
FIG. 2 is a schematic cross-sectional view of an image processing apparatus in which the present invention is applied.

FIG. 2 is a schematic cross-sectional view of an image processing apparatus embodying the present invention, composed of an image forming unit or printer 11, a sheet feed unit 12, a both-side unit 13 and a sheet discharge unit 14. The printer 11 is composed of a sheet feed roller 11*a*; registration rollers 11*b*; a photosensitive drum 11*c*; a conveyor belt 11*d*; *a* fixing station 11*e*; a deflecting cam 11*f* etc. The sheet feed unit 12 is composed of sheet cassettes 12*a*, 12*b*; a paper deck 12*c*; a sheet feed roller 12*d* etc. The both-side unit 13 is composed of a transport poth 13*a*; an intermediate tray 13*b*; a sheet feed roller 13*c*; a transport path 13*d*; a direction control flap 13*e*; etc. The sheet discharge unit 14 is composed of a tray 14*a*; an exit 14*b* etc.

In the one-side copying mode, the recording sheet is supplied, by the rotation of the sheet feed roller 11*a*, from the cassette 12*a* to the registration rollers 11*b*. Then, in synchronization with the image formed on the photosensitive drum 11*c*, the recording sheet is advanced by said registration rollers 11*b*. Along the periphery of the photosensitive drum 11*c*, there are provided various process means such as a high-voltage charger, developing stations etc., but they will not be explained in detail as they are already well known in the field of electrophotographic process.

The recording sheet bearing drum 11*c* is transported by the conveyor belt 11*d* to the fixing station 11*e*. After passing the fixing station 11*e*, the recording sheet is discharged through the exit 14*b* and placed on the tray 14*a*. The recording sheet placed in the paper deck 12*c* is fed by the sheet feed roller 12*d* until it reaches the registration rollers 11*b* through an aperture 12*e*, and is thereafter transported in the same manner as the sheet supplied from the cassette 12*a*.

In the both-side copying mode or the overlay copying mode, the image formation on the first side is conducted on a recording sheet supplied from the cassette 12*a* or 12*b*, or the paper deck 12*c*, and the recording sheet is transported by the deflecting cam 11*f* to the both-side unit 13. The cam 11*f* deflects the direction of the recording sheet in response to an instruction from the control section 2*b*, according to whether the image formation has been made on the first side of the sheet in the both-side copying mode. The recording sheet transported to the both-side unit 13 passes the path 13*a* and is placed on the intermediate tray 13*b*, with the image-bearing side upwards. In case of forming plural both-side copies from a same original, the image formation on the first side is conducted on the recording sheets of a preset number supplied from the cassette 12*a* or 12*b* or the paper deck 12*c*, and the recording sheets bearing image on the first side thereof are stored in the intermediate tray 13*b*. Subsequently, the recording sheets on the intermediate tray 13*b* are fed, one by one, by the sheet feed roller 13*c* for the image formation again on the second side or the first side. Thereafter, through a procedure the same as in the copying on the first side, the recording sheets are discharged through the exit 14*b* to the tray 14*a*. Sensors S1–S4, S6–S9 are provided to inspect the transport state of the recording sheets and detect sheet jamming, while a sensor S5 detects the presence of recording sheets on the intermediate tray 13*b*.

In the overlay copying mode of the present invention, at first the image formation on the first face side is made on the recording sheets supplied from the cassette 12*a*, 12*b* or the paper deck 12*c* according to a known electrophotographic process. Then, the control section 2*b*, shown in FIG. 1 and composed, for example, of a microcomputer releases an istruction to send the recording sheets from the fixing station 11*e* to the both-side unit 13 by the deflecting cam 11*f*. The instruction is released in case of image formation on the first side in the overlay copying mode. The recording sheets transported to the both-side unit 13 are forwarded to the transport path 13*a*. The control section 2*b* releases an instruction to drive the direction control flap 13*e*, whereby the recording sheets are stored on the intermediate tray 13*b*, with the image-bearing side downwards. The intermediate tray 13*b* can store about 50 recording sheets. Then, when the image reading means 2 starts to read an original to be overlaid, the recording sheet on the intermediate tray 13*b* is advanced by the feed roller 13*c* to the path 13*d* and stopped at the registration rollers 11*b*. Subsequently, the recording sheet is forwarded toward the photosensitive drum 11*c* at a synchronized timing, and the copy sequence as explained before is repeated until all the originals to be overlaid are copied.

After the formation of overlaid images, the sheets are controlled in the same manner as in the both-side copying in order to prepare for the copying on the second side, and, after the image formation, are discharged through the exit 14*b* onto the tray 14*a*.

Figure 3A:
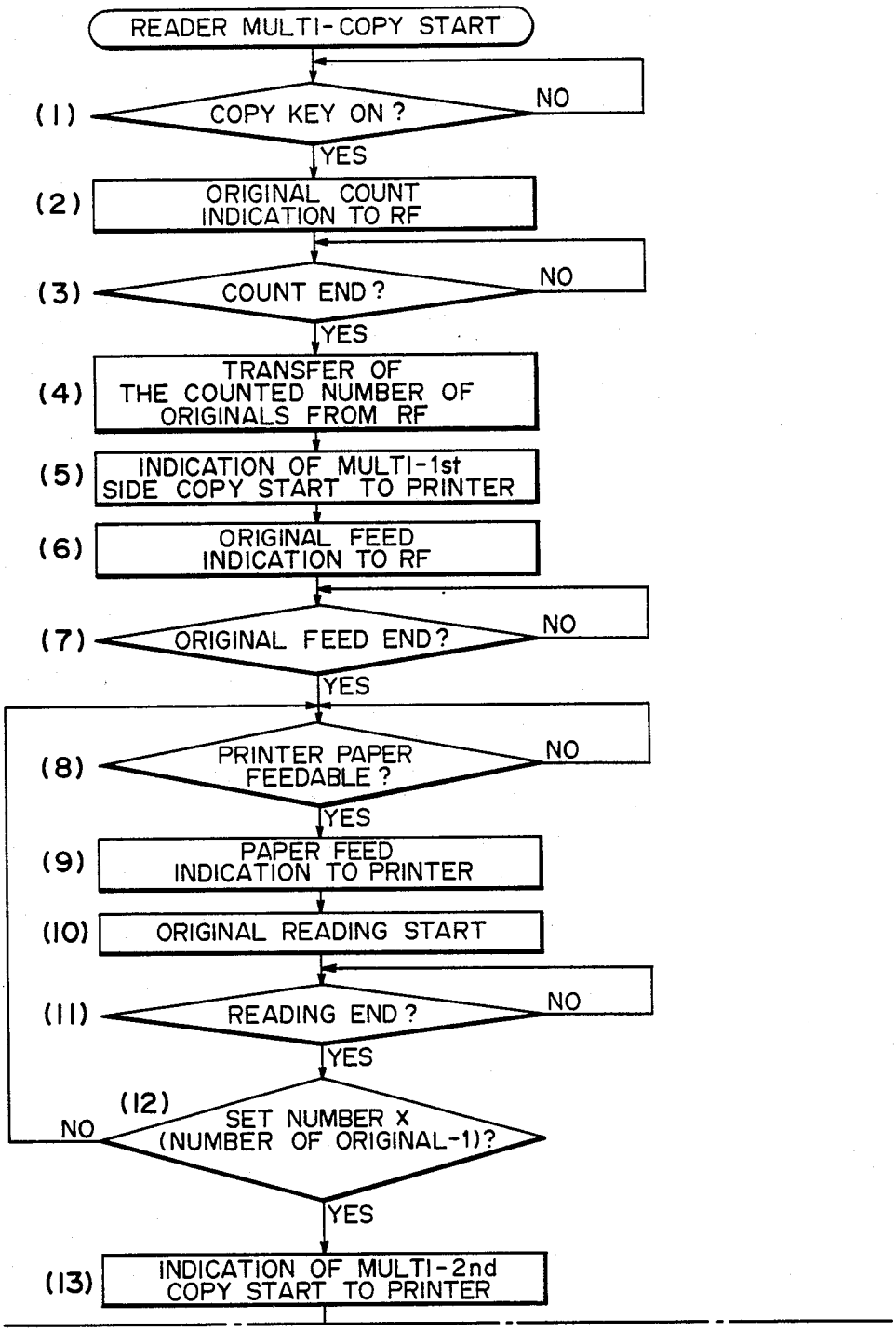
FIG. 3, 3A and 3B represents a flow chart which is shown in detail in FIGS. 4A and 4B showing the original reading operation of image reading means shown in FIG. 1.
Figure 3B:
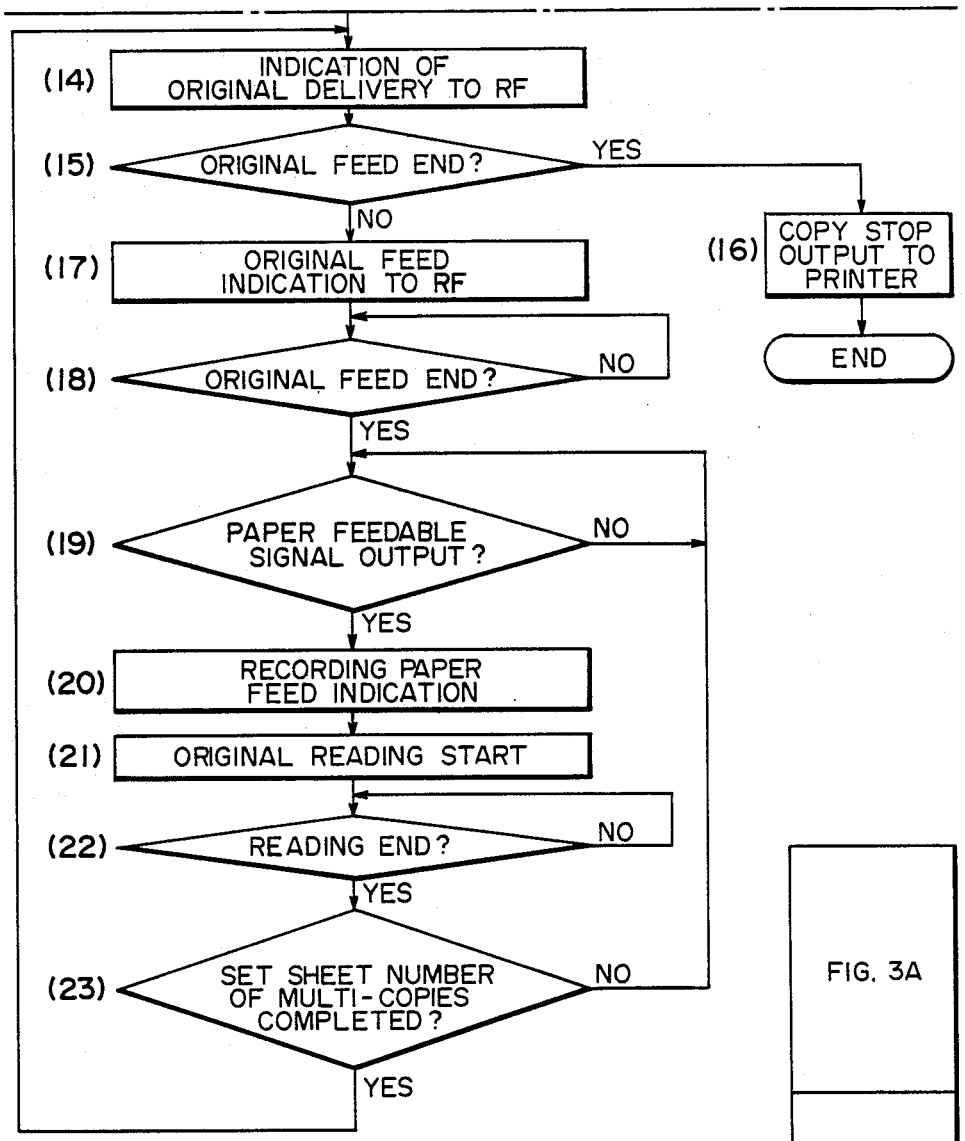
Figure 3:
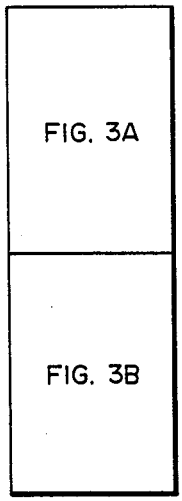

Now, reference is made to FIG. 3 for explaining the control procedure of the image reading means 2 shown in FIG. 1.

FIG. 3 is a flow chart showing the original reading operation of said image reading means 2.

When the operator selects the overlay copying mode in the operation section 2*a*, there is awaited the actuation of the unrepresented copy key (step 1), and, upon actuation, the control section 2*b* instructs the original feed means 1 to count the number of originals (step 2). Thus, the originals in a stacker in the original feed means 1 are supplied in succession onto the platen, and are again discharged into the stacker without exposure. The program awaits the completion of original counting (step 3), and, upon its completion, the original feed means 1 informs the control section 2*b* of the counted number of originals by serial communication (step 4). Subsequently, an instruction is given to the image forming means 3 for starting the copying on the first side in the overlay copying mode (step 5), and an instruction is given to the original feed means 1 for feeding an original which is to be regarded as a mother original (step 6). The program then awaits the arrival of the original at the platen (step 7), and, upon reception of a signal by serial communication from the original feed means 1 to the control section 2*b* indicating the completion of original feeding, then awaits the image forming means to become ready for receiving a recording sheet (step 8). When such ready state is reached, an instruction is given to the image forming means 3 to feed the recording sheet (step 9). Subsequently, the image reading means 2 starts the original reading (step 10). Upon completion of image reading of a page (step 11), a discrimination is made whether image formations of (number of copies preset in the operation section 2*a*)×(number of originals counted by the original feed means minus one) are completed (step 12), and, if not, the program returns to the step 8. On the other hand, if completed, an instruction is given to the image forming means 3 to start the copying operation on the second side in the overlay copying mode (step 13). Then, the control section 2*b* instructs the original feed means 1 to discharge the mother original (step 14), whereby the mother original on the platen is returned to the original feed means 1. The control section 2*b* identifies whether all the originals in the original feed means 1 have been fed (step 15), and, if completed, an instruction is given to the image forming means 3 to terminate the copying operation (step 16). On the other hand, if all the originals have not been fed, an instruction is given to the original feed means 1 to feed an original (step 17). Then, the program awaits the completion of the original feeding (step 18), and, upon said completion, awaits a sheet feed enable signal from the image forming means 3 (step 19). In response to said signal, the image forming means 3 is instructed to start the sheet feeding (step 20), and the original reading is initiated (step 21). Then, the program awaits the completion of original reading (step 22), and, upon completion, a discrimination is made whether overlay copyings of a preset number have been completed (step 23). If not, the program returns to the step 19, but, if completed, the program returns to the step 14.

Figures 4, 4A:
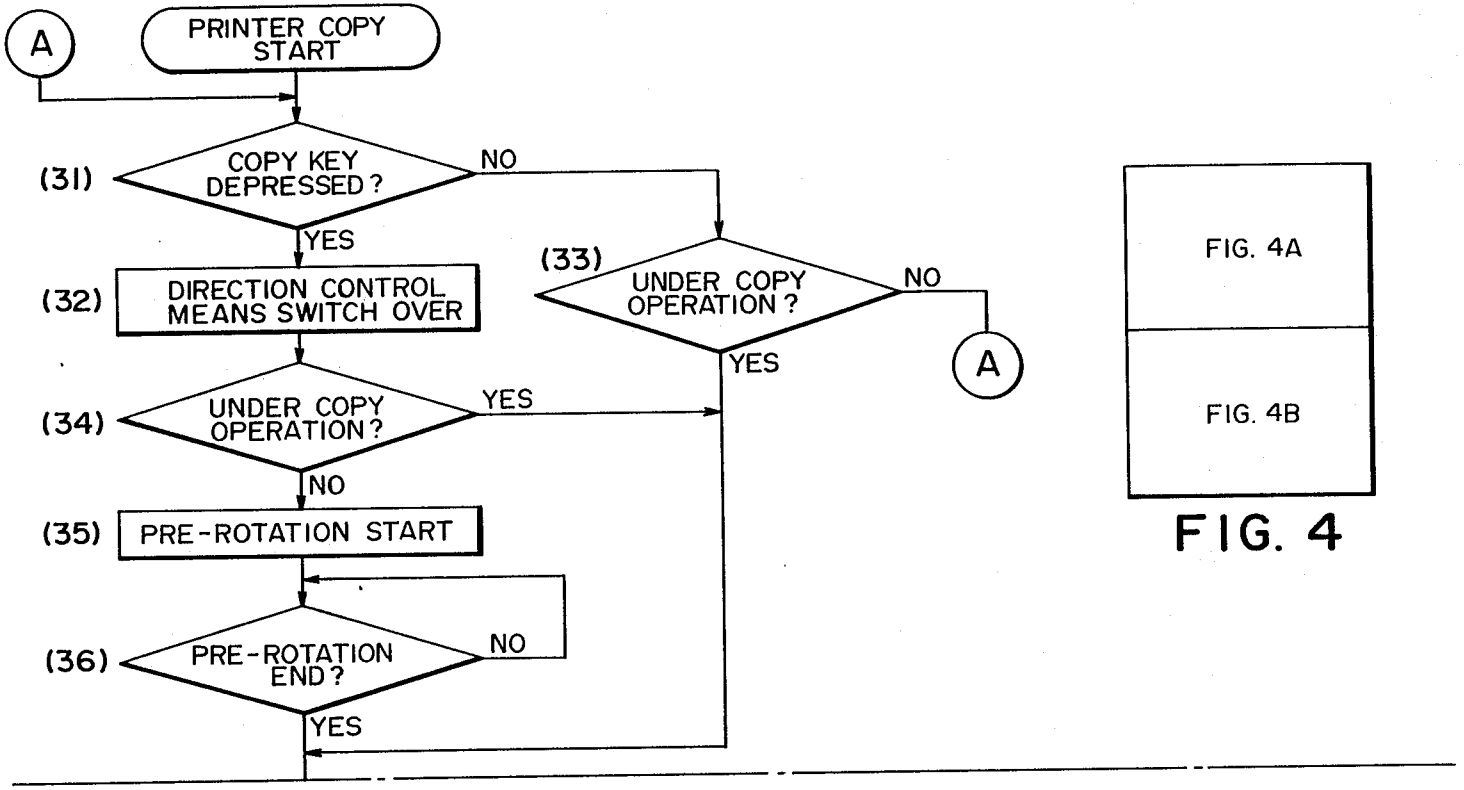
FIG. 4, 4A and 4B is a flow chart showing the control operation of an image forming unit shown in FIG. 1.
Figure 4B:
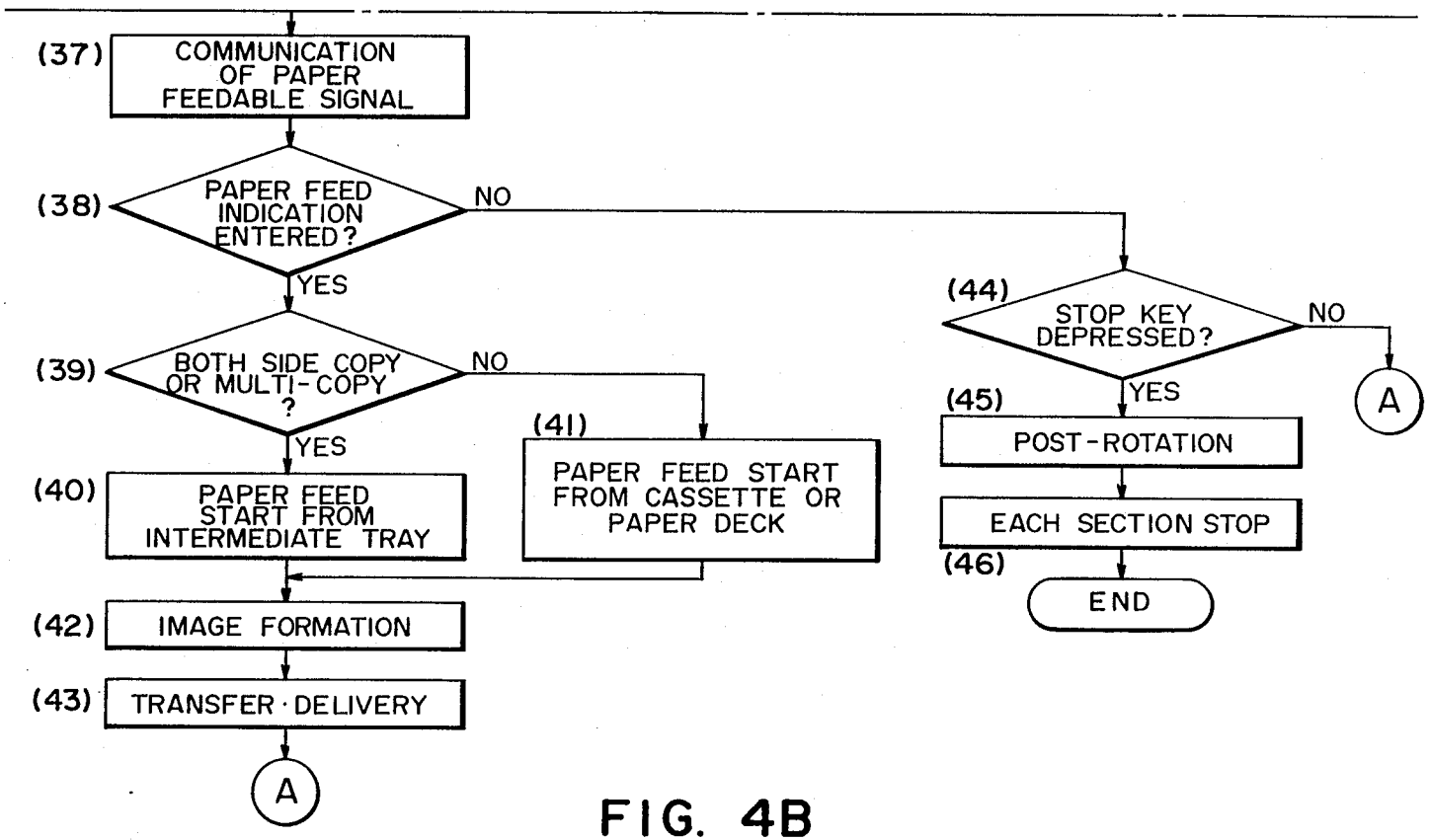

Now reference is made to FIG. 4 for explaining the control operation of the image forming means 3 shown in FIG. 1.

FIG. 4 is a flow chart showing the control operation of said image forming means.

At first a discrimination is made as to whether the unrepresented copy key in the operation section 2*b* has been actuated (step 31), and the direction control means 4*b* is positioned according to the selected copying mode (step 32). On the other hand, if the copy key has not been actuated in step 31, a discrimination is made as to whether a copying operation is in progress (step 33), and the program returns to the step 31 in case of negative discrimination, or proceeds to a step 37 in case of affirmative discrimination.

Then, there is discriminated whether a copying operation is in progress (step 34), and, in case of affirmative discrimination, the program proceeds to step 37. On the other hand, in case of negative discrimination, a pre-rotation step is initiated in the image forming means 3 for stabilizing image forming conditions such as conditions of charging, exposure, development, etc. (35). The next step awaits the completion of the pre-rotation step (36), and, upon completion thereof, a sheet feed enable signal is supplied to the image reading means 2 (37). A succeeding step identifies whether an instruction for sheet feeding is given from the control section 2*b* to the image forming means 3 (38), and, if such instruction is given, a next step discriminates whether the recording sheet supplied is for a both-side or overlay copying (39). Then, the sheet feeding is started either from the intermediate tray 4*a* in case of affirmative discrimination (40), or from the cassette 12*a* or 12*b* or paper deck 12*c* (41). Subsequently, image formation is executed (42) according the image signals supplied from the image reading means 2, then the recording sheet is discharged (43) and the program returns to the step 31.

On the other hand, in case of a negative discrimination in the step 38, a next step identifies whether the stop key has been actuated (44), and, if not, the program returns to the step 31. On the other hand, if the stop key has been actuated, there is initiated a post-rotation step for cleaning the drum in preparation for next image formation (45). After the post-rotation step, a stop command is given to various units to terminate the control function (46).

The foregoing embodiment is constructed in such a manner that the number of originals is counted by the original feed means 1, but it is also possible to manually set the number of originals in the operation section 2*a*, then to copy the first original on the first sides of the recording sheets of the present number, and to overlay the ensuing originals on the first sides. Also, the foregoing embodiment is limited to the case of overlaying the images of second and ensuing originals on a side of the recording sheets on which the reference image of the original is formed, but it is also possible to record the image of the first original on a first side of the recording sheets and to record the images of the ensuing originals on a second side of the recording sheets.

Figure 5:
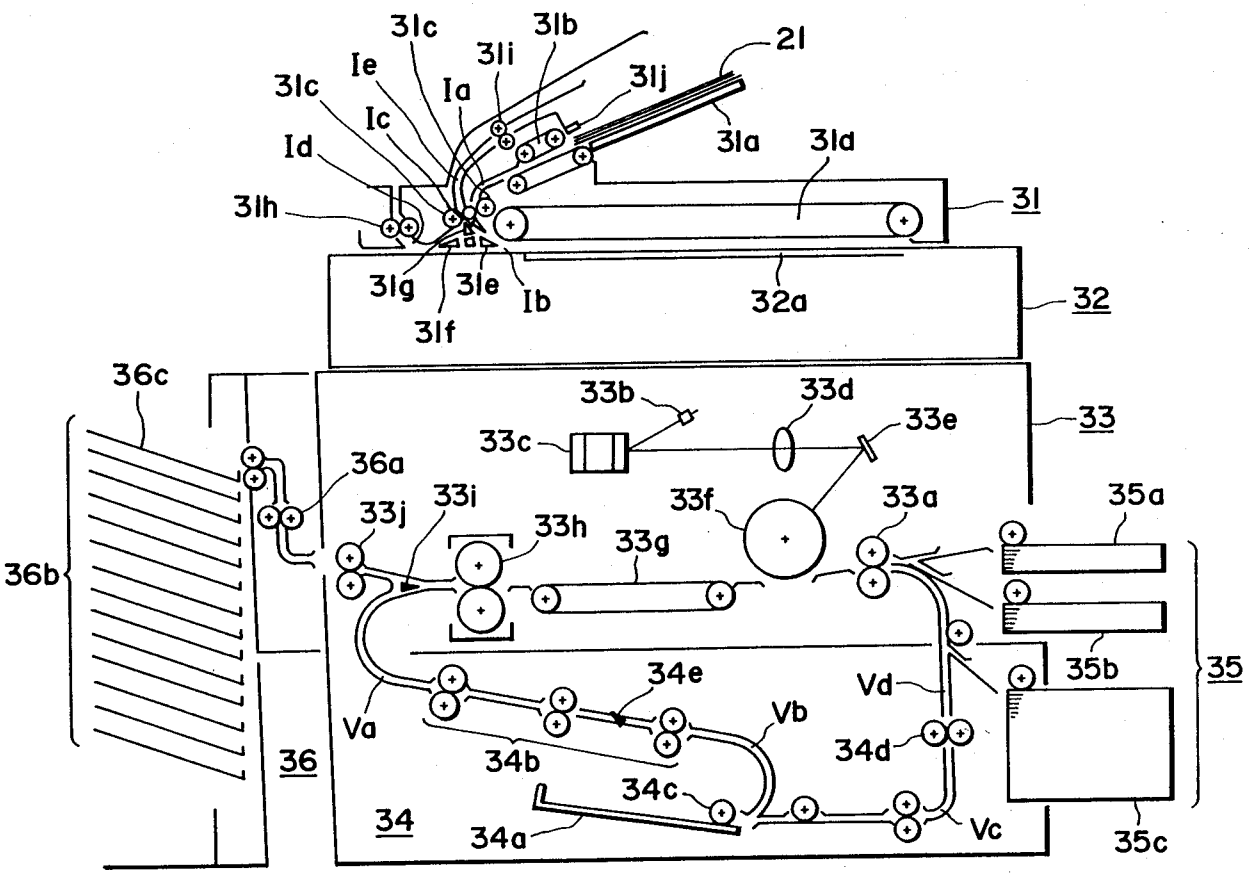
FIG. 5 is a cross-sectional view of a two-side copying machine embodying the present invention.

FIG. 5 is a cross-sectional view of a both-side copying machine embodying the present invention, composed fo an original feed unit 31, an image reading unit 32, image forming means 33, a both-side unit 34, a sheet feed unit 35, and a sheet discharge unit 36.

The original feed unit 31 is composed of an original stacker tray 31*a;* original feed rollers 31*b;* transport rollers 31*c;* a conveyor belt 31*d;* deflecting cams 31e–31g; transport rollers 31h etc. Ia–Ih indicate sheet paths.

The image reading unit 32 is provided with a platen 32a for reading an original placed thereon with an unrepresented scanning system composed, for example, of a CCD, and processes the image signals with an unrepresented CPU.

The image forming means 33 is composed of registration rollers 33a; a laser 33b; a scanner 33c; an optical lens 33d; a scanning mirror 33e; a photosensitive drum 33f; a conveyor belt 33g; a fixing unit 33h, a deflecting cam 33i, sheet discharge rollers 33j etc.

The both-side unit 34 is composed of an intermediate tray 34a; transport rollers 34b; a sheet feed roller 34c; transport rollers 34d etc.

The sheet feed unit 35 is composed of sheet cassettes 35a, 35b; and a paper deck 35c. The paper deck 35c receives recording sheets from a sheet path Vd of the both-side unit 34.

The sheet discharge unit 36 is composed of sheet discharge rollers 36a; a sorter 36b; and sheet bins 36c, and is capable of stacking the discharged sheets in correct order by moving the sheet bins 36c of the sorter 36b by means of unrepresented driving means, in response to signals emitted from the control section of the image reading unit 32.

In the following there will be explained the function of the above-explained copying machine.

One-side and both-side originals 21, with the first sides upwards, are placed on the stacking tray 31a. When a copy key of an unrepresented operation section of the image reading unit 32 is depressed in this state, the original feed roller 31b of the original feed unit 31 is rotated, thereby advancing the uppermost one of the originals 21 stacked on the tray 31a. The original 21 is advanced through the paths Ia and Ib by the transport rollers 31c and brought to the platen 32a by the conveyor belt 31d. In the already known manner, the original 21 is so controlled as to exactly stop on the platen 32a, by means of unrepresented sheet sensors provided on sheet paths and unrepresented timing pulse generators mounted on the roller driving systems. Thus, the original 21 is stopped on the platen 32a, with the first page thereof downwards. Then, the original reading unit or reader 32 starts to scan the original as explained before, and identifies the presence or absence of image. If the first page of the original 21 has an image, the reader 32 identifies the presence of image, thereby supplying a copy start instruction to the image forming means or printer 33, and re-starts original scanning for releasing image signals. Also, the recording sheet is fed from the sheet cassette 35a or 35b, or the sheet deck 35c, housing sheets of a size designated by the reader 32. The recording sheet is temporarily stopped at the registration rollers 33a. Then, in response to an image front end signal from the reader 32, the registration rollers 33a are started to advance the recording sheet, thereby synchronizing the sheet with a toner image formed on the photosensitive drum 33f, and the toner image is transferred onto the sheet. Subsequently, the recording sheet, bearing the transferred toner image, is transported by the conveyor belt 33g and reaches the fixing unit 33h where the image is fixed by heat and/or pressure. After passing the fixing unit 33h, the recording sheet is transported, by the deflecting cam 33i, toward the sheet path Va of the both-side unit 34, in order to prepare for additional copying. The recording sheet is then transported through the sheet path Vb by the transport rollers 34b and is placed on the intermediate tray 34a, with image bearing side upwards. In the course of transportation of the sheet to the intermediate tray 34a, for example, at the exit of the fixing unit 33h, the printer 33 sends a signal for enabling the copying of second page, to the reader 32. In response the reader 32 supplies an original inverting instruction to the original feed unit 31, which moves the original 21, placed on the platen 32a with the first page downwards, to the left by the conveyor belt 31d. The original 21 passes the sheet path Id by means of the deflecting cams 31e, 31f, and is temporarily stopped after passing the cam 31f by means of the transport roller 31h. Subsequently, the transport roller 31h is reversed, and the deflecting cams 31f, 31g are shifted to guide the original 21 toward the sheet path Ie. Thus, the original 21 is guided to the path Ie by means of the transport roller 31h and the deflecting cams 31f, 31g, and the roller 31e is stopped when the original passes the roller 31c. Then, the transport roller 31c is reversed and the deflecting cams 31e, 31g are shifted to forward the original 21 to the path Ic. Finally, the original 21 is stopped on the platen 32a, with the first page thereof upwards, by the conveyor belt 31d. In this state, the reader 32 starts scanning to identify the presence or absence of image. It is not certain whether the second page of the first original has an image. If present, the reader supplies the copy start instruction to the printer 33 and re-starts the original scanning for releasing the image signals. On the other hand, if there is no image on the second page of the first original 21, the reader 32 instructs the original feed unit 31 to feed a second original 21. In response, the original feed unit 31 discharges the original 21 in a sequence same as in the original inversion, i.e. through the sheet paths Id and Ie, by means of the discharge roller 31i. The discharged original 21 is placed on the stacker tray 31, with the first page downwards, and separated from the remaining originals thereon by a partition 31j. Simultaneously, with the discharge of the original, the second original is supplied from the stacker tray 31a to the platen 32a, and stopped thereon, whereupon the reader 32 starts original scanning for identifying the presence or absence of an image. If present, the reader 32 supplies a copy start instruction to the printer 33 and restarts the original scanning for releasing the image signals. If there is no image, the reader 32 supplies an original inverting instruction to the original feed unit 31.

If an image is present either on the second page of the first original 21, or on the first page of the second original, i.e. The third page of the originals, the reader 32 supplies the printer 33 with an instruction to form a copy on the second side of the recording sheet. In response, the printer 33 instructs the both-side unit 34 to feed the recording sheet from the intermediate tray 34a. thus, the recording sheet is advanced by the feed roller 34c of the intermediate tray 34a, and transported through the paths Vc, Vd by the transport rollers 34d to the registration rollers 33. Subsequently, the registration rollers 33 are activated, and the first recording sheet receives toner transfer on the second side thereof, and is transported to the fixing unit 33h through the transport rollers 33g. After image fixation in the fixing unit 33h, the recording sheet is transported toward the discharge rollers 33j by the deflecting cam 33i. After passing the rollers 33j, the recording sheet is discharged by the discharge rollers 36a onto one of the sheet bins 36c of the sorter 36b, with the first side downwards. In this manner, the originals stacked on the stacker tray 31*a* of the original feed unit 31 are processed in succession until a complete cycle of the originals is detected by the position of the partition plate 31*j*, thereby providing a complete set of copies without page emission. If the sorter 36*b* is used, next both-side copying is started after a required number of recording sheets, bearing copied images on both sides, is discharged to the sheet bins 36*c*.

In the foregoing embodiment, all the originals are fed by the original feed unit, but it is also possible to feed the first original manually and to feed the ensuing originals by the original feed unit.

Though the foregoing embodiment has been explained by an example of a digital copying machine, the present invention is applicable also to an analog copying machine.

Furthermore, though the image formation in the foregoing embodiments is achieved by an electrophotographic process, it can also be achieved, for example, by an ink jet process or a thermal transfer process.

What is claimed is:

1. An image processing apparatus for forming images on sheets of recording material comprising:

original handling means for feeding an original, which has been set into an original loading section, to an exposure position, and for discharging the original from the exposure position after completion of exposure, said original handling means being operable to feed a successive original to the exposure position while the preceding original subjected to the exposure is discharged from the exposure position;

first and second storage means for storing recording material therein;

image forming means (i) operable in a first mode wherein a sheet of the recording material is fed from said first storage means, and an image corresponding to an original located at the exposure position is formed on a first side of the sheet of recording material, and thereafter the sheet of recording material being subjected to the image formation is temporarily stored in said second storage means, and (ii) operable in a second mode wherein the sheet of recording material is fed from said second storage means, and in image corresponding to an original located at the exposure position is formed on the first side or a second side of the sheet of recording material; and control means for controlling said image forming means in such a manner that the first mode is carried out $(n-1)\times m$ times on a first original which is initially fed by said original handling means, and the second mode is carried out m times on each of a second to an $n^{th}$ originals which are subsequently fed by said original handling means, where n represents the number of originals set into said original loading section, and m represents a desired number of sheets of recording material on which images are to be formed, and further wherein $n \geqq 3$ and $m \geqq 2$.

2. An apparatus according to claim 1, wherein said original handling means is adapted to return the originals discharged from the exposure position into said original loading section.

3. An apparatus according to claim 2, wherein said original handling means is operable to circulate the originals, for the purpose of sensing the number of originals, prior to the original feeding for image formation.

* * * * *

UNITED STATES PATENT AND TRADEMARK OFFICE

CERTIFICATE OF CORRECTION

PATENT NO. : 4,831,411

DATED : May 16, 1989

INVENTOR(S) : KIYOHISA SUGISHIMA

It is certified that error appears in the above-identified patent and that said Letters Patent is hereby corrected as shown below:

COLUMN 3

Line 4, "electrophographic" should read --electrophotographic--.

COLUMN 4

Line 6, "bearing drum 11c" should read --bearing the image transferred from the photosensitive drum 11c--.
Line 45, "face" should be deleted.
Line 50, "istruction" should read --instruction--.

COLUMN 6

Line 35, "according" should read --according to--.
Line 52, "present number," should read --preset number,--.
Line 63, "fo" should read --of--.

COLUMN 8

Line 50, "The" should read --the--.
Line 55, "thus," should read --Thus,--.

UNITED STATES PATENT AND TRADEMARK OFFICE

CERTIFICATE OF CORRECTION

PATENT NO. : 4,831,411

DATED : May 16, 1989

INVENTOR(S) : KIYOHISA SUGISHIMA

It is certified that error appears in the above-identified patent and that said Letters Patent is hereby corrected as shown below:

COLUMN 10

Line 11, "in image" should read --an image--.
Line 25, "m≧2." should read --m≧1.--.

Signed and Sealed this

Thirtieth Day of April, 1991

*Attest:*

HARRY F. MANBECK, JR.

*Attesting Officer*

*Commissioner of Patents and Trademarks*